US008087548B2

(12) United States Patent
Kimball

(10) Patent No.: US 8,087,548 B2
(45) Date of Patent: Jan. 3, 2012

(54) SPRAY PRODUCTS WITH PARTICLES AND IMPROVED VALVE FOR INVERTED DISPENSING WITHOUT CLOGGING

(75) Inventor: James F. Kimball, Greenfield, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 714 days.

(21) Appl. No.: 12/152,311

(22) Filed: May 14, 2008

(65) Prior Publication Data

US 2009/0283545 A1 Nov. 19, 2009

(51) Int. Cl.
*B67D 7/76* (2010.01)

(52) U.S. Cl. ..... 222/189.11; 210/431; 239/337; 128/200.23; 222/402.1; 222/464.2; 222/1

(58) Field of Classification Search ..... 222/189.06, 222/189.1, 189.11, 402.1, 402.22, 464.2, 222/62, 402.18–402.19; 210/323.1, 429, 210/431; 239/337; 128/200.18, 200.23
See application file for complete search history.

(56) References Cited

U.S. PATENT DOCUMENTS

| | | | | |
|---|---|---|---|---|
| 3,209,954 | A | 10/1965 | Webster | |
| 3,572,591 | A * | 3/1971 | Brown | 239/337 |
| 3,578,220 | A | 5/1971 | Green et al. | |
| 3,613,728 | A | 10/1971 | Steiman | |
| 3,644,086 | A * | 2/1972 | O'Dell | 422/123 |
| 3,658,294 | A | 4/1972 | Ewald | |
| 3,690,515 | A | 9/1972 | Ewald | |
| 3,970,219 | A | 7/1976 | Spitzer et al. | |
| 3,972,473 | A | 8/1976 | Harrison | |
| 4,007,858 | A * | 2/1977 | Shay | 222/633 |
| 4,030,667 | A | 6/1977 | Le Guillou | |
| 4,035,303 | A * | 7/1977 | Ufferfilge | 210/316 |
| 4,124,149 | A | 11/1978 | Spitzer et al. | |
| 4,141,472 | A | 2/1979 | Spitzer et al. | |
| 4,413,755 | A | 11/1983 | Brunet | |

(Continued)

FOREIGN PATENT DOCUMENTS

| | | | |
|---|---|---|---|
| DE | 90633 | C | 2/1897 |

(Continued)

OTHER PUBLICATIONS

International Search Report and Written Opinion dated Dec. 16, 2009 Appl. No. PCT/US2009/002954.

*Primary Examiner* — Kevin P Shaver
*Assistant Examiner* — Andrew Bainbridge

(57) ABSTRACT

A product is disclosed for inverted spray dispensing of material that comprises at least some particulate matter. The dispensing end of the container is connected to a valve, which includes a valve that moves from a biased closed position to an open position to discharge the product downward through the valve, when the dispensing end of the container is directed downward. An inlet end of the valve is spaced vertically above the dispensing end of the container when the dispensing end of the container is directed downward. The inlet end of the valve or spring cup is connected to a mesh filter having a pore size at least as large as an average diameter of the solid particles. Even when the container and a layer of settled particles forms at the dispensing end of the container, valve and mesh filter are designed so that at a portion of the proximal end of the mesh filter is disposed above the layer of settled particles to prevent clogging of the mesh filter.

17 Claims, 5 Drawing Sheets

U.S. PATENT DOCUMENTS

| | | | | |
|---|---|---|---|---|
| 4,418,847 | A | 12/1983 | Beard | |
| 4,546,905 | A | 10/1985 | Nandagiri et al. | |
| 4,882,055 | A * | 11/1989 | Stamstad | 210/483 |
| 5,074,440 | A | 12/1991 | Clements et al. | |
| 5,331,953 | A * | 7/1994 | Andersson et al. | 128/200.14 |
| 5,447,150 | A * | 9/1995 | Bacon | 128/200.14 |
| 5,472,143 | A | 12/1995 | Bartels et al. | |
| 5,738,252 | A | 4/1998 | Dodd et al. | |
| 5,878,917 | A * | 3/1999 | Reinhard et al. | 222/156 |
| 6,439,435 | B2 * | 8/2002 | Rosenberg | 222/162 |
| 6,491,187 | B2 | 12/2002 | Walters | |
| 6,833,072 | B1 | 12/2004 | Krestine et al. | |
| 6,942,125 | B2 | 9/2005 | Marelli | |
| 6,966,467 | B2 | 11/2005 | Di Giovanni et al. | |
| 6,978,915 | B1 | 12/2005 | Russell | |
| 7,121,434 | B1 | 10/2006 | Caruso | |
| 7,137,536 | B2 | 11/2006 | Walters et al. | |
| 7,143,959 | B2 | 12/2006 | Smith et al. | |
| 7,182,227 | B2 | 2/2007 | Poile et al. | |
| 7,195,139 | B2 | 3/2007 | Jaworski et al. | |
| 7,246,722 | B2 | 7/2007 | Walters et al. | |
| 7,255,102 | B2 * | 8/2007 | Modi | 128/200.14 |
| 7,350,676 | B2 | 4/2008 | Di Giovanni et al. | |
| 2004/0262340 | A1 * | 12/2004 | Kress | 222/633 |
| 2005/0017026 | A1 | 1/2005 | Yerby et al. | |

FOREIGN PATENT DOCUMENTS

| | | | |
|---|---|---|---|
| EP | 0449774 | A | 10/1991 |
| FR | 413766 | A | 8/1910 |
| WO | 2008020268 | A | 2/2008 |

* cited by examiner

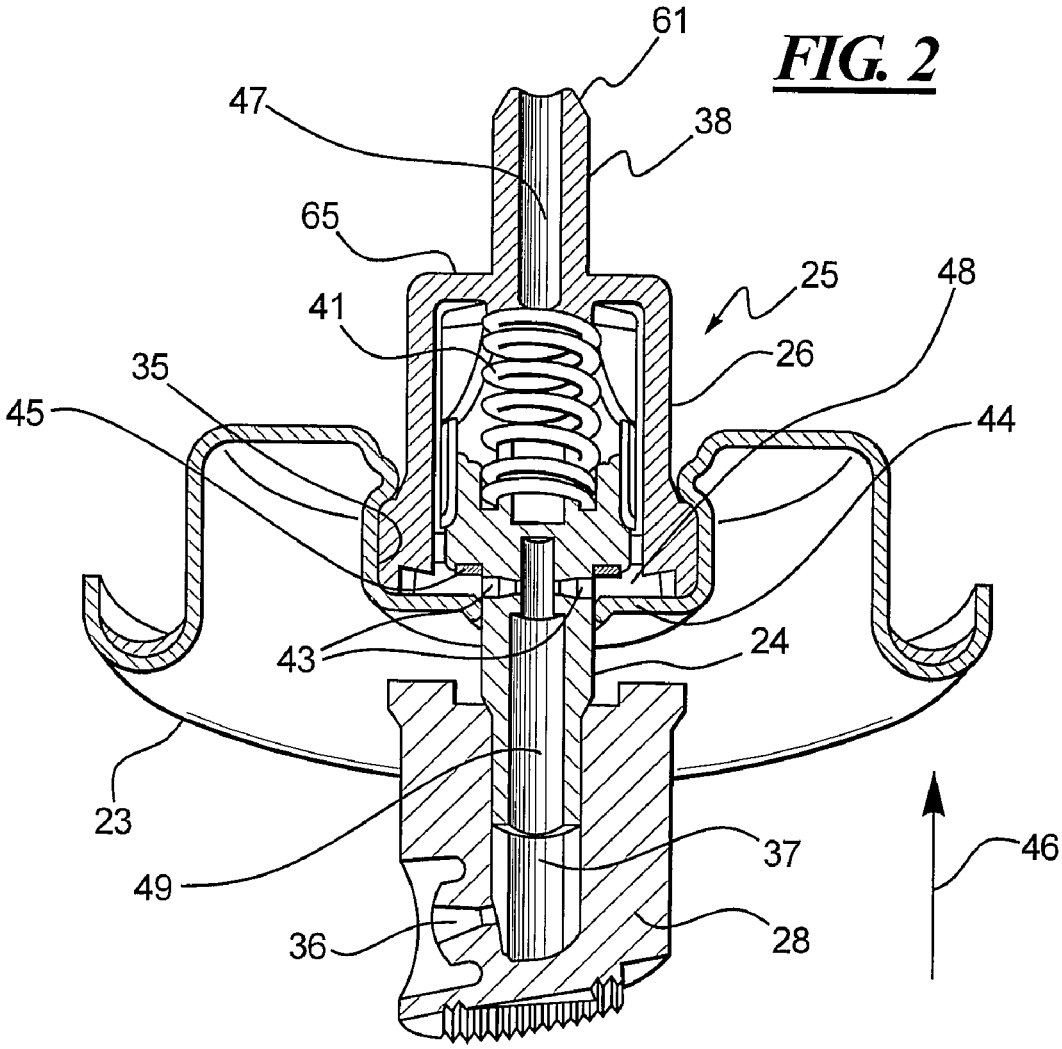
FIG. 2
FIG. 3
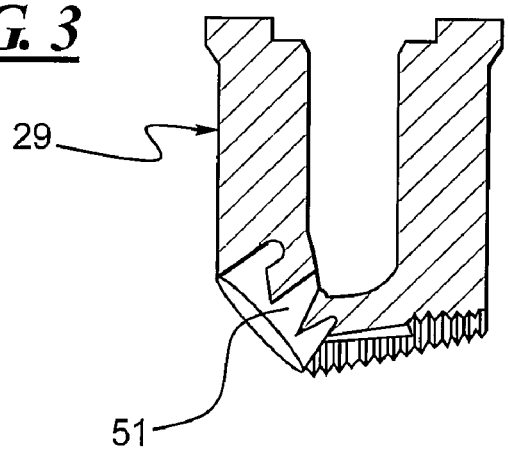

FIG. 4
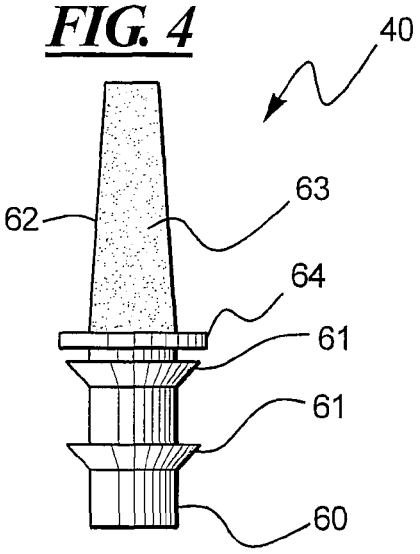
FIG. 5
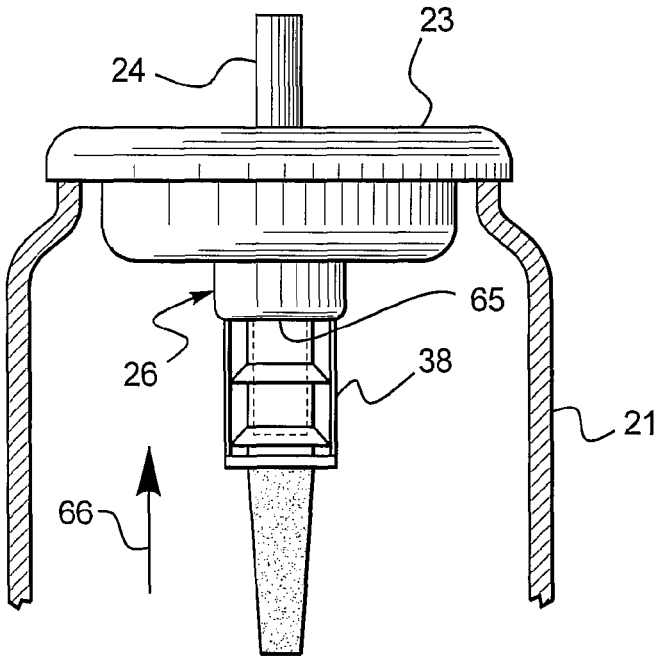
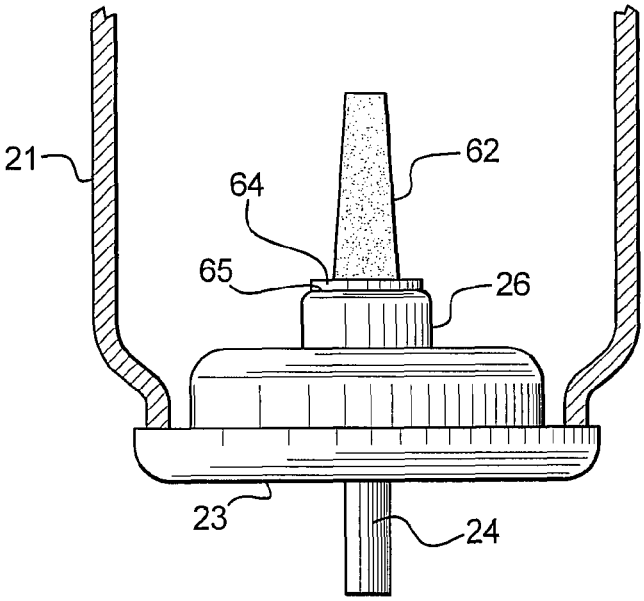
FIG. 6

SPRAY PRODUCTS WITH PARTICLES AND IMPROVED VALVE FOR INVERTED DISPENSING WITHOUT CLOGGING

BACKGROUND

1. Technical Field

A product is disclosed that is intended to be dispensed in an inverted position, or where the spray valve is directed downward, and which includes powdered or particulate material in the product to be dispensed. The product includes a valve and mesh filter system which avoids clogging of the valve during inverted dispensing. This disclosure is directed to both aerosol and non-aerosol spray systems that are intended to be sprayed downward or in an inverted position.

2. Description of the Related Art

Conventional valves are known for dispensing product in the form of a spray. These products are normally a liquid, an emulsion, a powder or combinations thereof as well as a propellant to expel the product from the aerosol container. Propellants used include pressurized gases such as propane, isobutane, n-butane, and mixtures thereof or pressurized gases such as carbon dioxide, nitrogen, etc. The valves that are used to dispense these products generally have a plastic dip tube with an open end that extends to or near the bottom of the aerosol can.

When the valve is actuated, the product and propellant travel up the dip tube and are dispensed through a nozzle. In some designs, a vapor tap on the valve is used to allow propellant vapor to mix with the product before the mixture is dispensed through the nozzle. Although these designs are fairly successful, they cannot be employed when compressed gases such as carbon dioxide are used as the propellant because compressed gases usually have limited solubility in the product and, when a vapor tap is provided, and the container is in the upright position, there is a rapid "bleed off" of the propellant vapor causing sudden drop in pressure, and eventually total loss of propellant before all of the product has been dispensed. As a result, a substantial amount of product remains in the container and cannot be dispensed and is therefore wasted. Even when liquefied gases such as isobutane and propane are used that are soluble in the product, bleed off occurs to at least some extent, resulting in wasted product remaining in the container.

A valve is typically located internally within the aerosol container. The valve is biased into a closed position. The valve stem cooperates with the valve to open the valve. An actuator engages and pushes the valve stem to open the valve to release the pressurized product. The product is normally dispensed through a spray nozzle. The dispensing rate can vary greatly and depends in large part upon the designs of the nozzle, valve and actuator as well as the propellant, pressure and the product to be dispensed.

Various types of actuators have been utilized. The first and the most basic type is an actuator button that is affixed to the valve stem and which includes the spray nozzle. Depression of the button pushes the valve stem downward to open the valve for dispensing the product. A protective cap is often provided that engages a rim of the container for preventing accidental depression of the button and discharge of the product.

Another type of actuator is an aerosol over cap. An aerosol over cap replaces the conventional protective cap and includes an actuator for opening the valve of the dispenser. Aerosols over caps typically include a base mounted on a rim of the container. Over caps also include an actuator pivotally mounted to the over cap base and that engages the valve stem.

The movement of the actuator of the over cap causes a depression of the valve stem to open the valve for dispensing the product through the nozzle.

Another type of actuator is a trigger device. With a trigger actuator, a base is mounted either to the container rim or the mounting cup rim for supporting the trigger. The trigger engages the valve stem. Movement of the trigger from an extended position to a protracted position depresses the valve stem to open the valve and dispense the product. Another design includes a tiltable valve, which includes a spring to bias the stem outwardly to a closed position. Movement of the stem inwardly to tilt the spout opens the valve and releases the product.

For low viscosity products, the spray nozzle and valve are traditionally located on the top of the container for dispensing the product through the spray nozzle with the container in an upright position. For high viscosity products, the product can be dispensed in upright or horizontal positions. However, other high viscosity products may need to be dispensed in an inverted position.

Dispensing containers or cans for high viscosity products are normally designed for dispensing in an upright position. For example, rotary valves may be mounted on the container to control the discharge of the contents from the container when the container is in an inverted position. The valve has a stem that opens the valve upon rotation. Some aerosol dispensers are intended to be stored in an inverted position where an over cap, spray nozzle and the valve are located on the bottom of the aerosol container. Although these types of dispensers are stored in an inverted position, the aerosol container is turned upright to dispense the product from the container.

One inverted aerosol dispensing device includes an under cap secured to a bottom of the container for supporting the container in an inverted position. The actuator moves relative to the under cap for moving the valve stem for discharging the product in a generally downwardly direction through the under cap. Although this valve design is used extensively, it suffers from many disadvantages. One disadvantage is that, when the container is actuated in the inverted position, the open end of the dip tube is above the product level in the container and only propellant is dispensed.

Another dispensing option is the use of a piston pump, commonly called a trigger-sprayer or a fine mist sprayer that are found attached to containers that are typically non-pressurized. The use of such a pump also incorporates a valve enabled by a orifice and a ball that when pressure is applied from within the pump, seals to enable dispensing of product and when pressure is relieved, the ball no longer seals the flow path and product is siphoned into a chamber for subsequent dispensing.

Another disadvantage of conventional aerosol systems is the potential for clogging of the valve orifices by particles that are components of the product. One attempt to solve the clogging problem includes a mesh filter that is attached to the bottom of the dip tube and the product is filtered before it is dispensed. However, clogging can still occur and, if the product includes particulate matter that needs to be dispensed, simple mesh filters are inadequate. In addition to clogging problems, valves with small orifices are difficult to manufacture and small changes in tolerances can cause wide variations in the dispensing of the product. Further, as discussed above, dip tubes, and therefore dip tube filters cannot be used for products that need to be dispensed in an inverted position because large amounts of product will remain below the dip tube opening when the can is inverted.

Therefore, there is a need for an improved aerosol container/product that reliably discharges product in an inverted position and that includes particulate or powdered matter as a part of the product. Similarly, there is a need for an improved non-aerosol spray product that can reliably discharge product in an inverted position that includes particulate or powdered material.

SUMMARY OF THE DISCLOSURE

An improved product is disclosed for inverted dispensing of material that comprises at least some particulate matter. The container contains the product to be dispensed and a propellant, if the container is an aerosol container. The dispensing end of the container is connected to a valve, which moves from a biased closed position to an open position to discharge the product downward through the valve stem of the valve and when the dispensing end of the container is directed downward.

The valve stem includes an inlet end disposed within the container. The inlet end of the valve stem is spaced vertically above the dispensing end of the container when the dispensing end of the container is directed downward. The inlet end of the valve stem is connected to a mesh filter having a pore size at least as large as an average diameter of the solid particles. When the container is inverted and the dispensing end is directed downward, the product can form a layer of settled particles extending upward from the dispensing end upward to a predetermined level. The container, valve and mesh filter are all designed so that a portion of the proximal end of the mesh filter is disposed above this layer of settled particles to prevent clogging of the mesh filter.

In a refinement, the container comprises a mounting cup sealably connected to the dispensing end of the container. The mounting cup includes a central opening for mateably receiving the valve. The valve includes a spring cup which either mateably receives or is connected to the valve stem that extends into the container. The inlet end of the valve stem is connected to the mesh filter, which is spaced above the dispensing end of the container.

The connection between the mesh filter element and the inlet end of the valve stem can vary greatly. A mateable engagement where a base portion of the mesh filter is received in the valve stem is one variation, or the inlet end of the valve stem may be received within the base portion of the mesh filter. Barbs, ribs or other friction-enhancing elements may be used to secure the connection between the mesh filter element and the valve stem.

In a refinement, the inner valve stem and mesh filter element are a unitary molded component.

In a refinement, the solid particles have diameters ranging from about 40 to about 60 microns.

In a refinement, pore sizes of the mesh filter range from about 80 to about 500 microns.

In a refinement, the mesh filter comprises from about 100 to about 500 pores.

In a refinement, the mesh filter comprises a distal open end that is connected to the inlet end of the valve stem. The mesh filter also includes a proximal end and a generally cylindrical screen sidewall extending between the distal and proximal ends of the mesh filter.

In one refinement, the proximal end of the mesh filter or filter does not include any pores and, in another refinement, the proximal end comprises part of the mesh filter. Obviously, the designs of the mesh filter or the filter can vary greatly.

For example, the mesh filter may include a tapered proximal end that may be conical or have opposing slanted sides, one of which includes the mesh filter, the other of which is solid.

In another refinement, the mesh filter may include a distal cylindrical end connected to the inlet end of the valve stem and a proximal cylindrical section with a proximal end that includes the mesh filter.

The mesh filter may also include a cylindrical section connected to the inlet end of the valve stem and a proximal end that comprises the mesh filter. Alternatively, the mesh filter may include a cylindrical section connected to the inlet end of the valve stem. The cylindrical section includes sidewall where the mesh filter is located.

As another alternative, the mesh filter may include a first cylindrical section connected to the inlet end of the valve stem and disposed between a second narrower cylindrical section that includes a proximal end where the mesh filter is located.

Throughout this specification, the terms mesh, mesh filter, filter, filter mesh, permeable wall, porous member, membrane and porous wall and other like terms are all intended to describe structures designed to prevent clogging of the valve by conglomerations of powdered material or particulate matter in the product that is preferably dispensed downward or in an inverted position. Accordingly, the terms mesh, mesh filter, filter, permeable wall, porous member, membrane and porous wall may be used interchangeably and, when used individually, are not intended to limit the scope of this disclosure.

A method of dispensing product comprising particles from a container in an inverted position is also disclosed. The method comprises: inverting the container with the dispensing end directed downward; allowing at least some of the particles to settle at the dispensing end of the container to provide a layer of settled particles extending upward from the dispensing end upward to a predetermined level below at least a portion of the mesh filter; and, opening the valve to expel product through the mesh filter.

A method of modifying an existing aerosol dispenser so that it may dispense material with powder or particulate matter from an inverted position is also disclosed. In this method, the inner valve stem or the portion of the spring cup that extends into the container space is modified by either attaching a mesh filter element to the inner valve stem or molding a mesh filter element onto the inner valve stem member. The method may also include removal of a dip tube which, of course, is ineffective for inverted aerosol dispensing.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 2 is a partial sectional view of a valve, actuator/nozzle and mounting gasket;

FIG. 3 is an alternative actuator/nozzle intended to be used with the embodiments disclosed herein;

FIG. 4 is a plan view of a disclosed valve stem mesh filter extension that prevents clogging by particulate material in the product when product is dispensed downward from an aerosol container;

FIG. 5 illustrates, schematically, installation of the valve stem mesh filter extension onto the valve stem shown in FIGS. 1 and 2;

FIG. 6 illustrates the valve stem mesh filter extension as installed onto the valve stem illustrated in FIGS. 1, 2 and 5;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
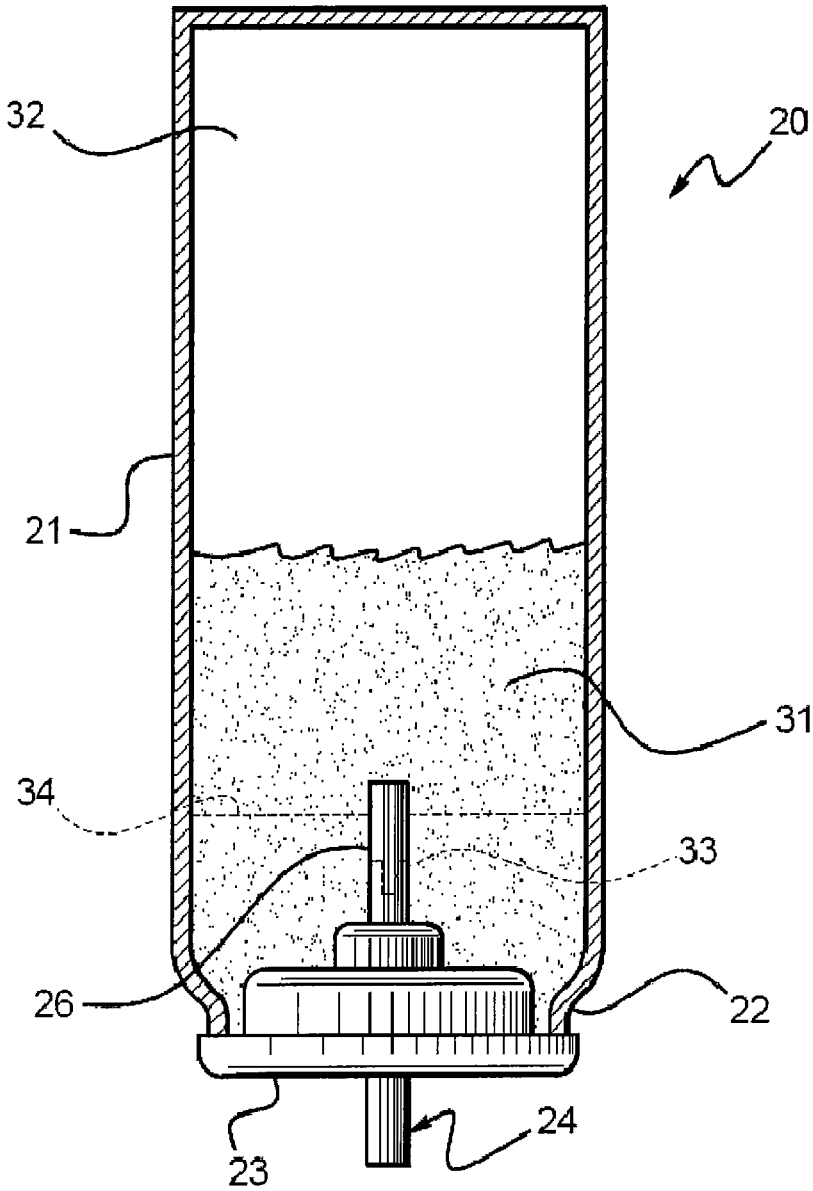
FIG. 1 (Prior Art)
FIG. 1 is a partial sectional view of an aerosol container in an inverted position for dispensing and a downward direction.

FIG. 1 illustrates a container 20 in an inverted position with a solid container body 21 that terminates at a lower rim 22 that is sealably connected to a mounting cup 23. The mounting cup 23 accommodates the valve stem shown generally at 24 which comprises part of an overall valve 25 that includes a spring cup 26 as illustrated in FIG. 2. Returning to FIG. 1, the outer valve stem 24 is received within an actuator body 28 (FIG. 2) or 29 (FIG. 3). The container 21 accommodates product 31 and propellant 32, which are shown schematically. In many instances, the product 31 will include particulate material as a part of a mixture, emulsion, suspension, foam, etc. Many prior art designs include a narrow slot shown in phantom lines at 33 and FIG. 1 which has a tendency to be clogged by particles or particulate matter in the product 31. This is particularly true if, the container 21 is left in the inverted position shown in FIG. 1 for extended time period and a layer 34 of settled particles forms which can then result in the clogging of the slot 33 or lower valve stem 26.

For background purposes, in FIG. 2, the inverted mounting cup 23 and actuator body 28 are illustrated in greater detail along with the orifice or spray nozzle 36. The details of the exit path 37 and swirl chamber (not shown), if used, are not important and will not be discussed here. The spring cup 26 includes an inner valve stem extension 38 which receives the mesh filter 40 shown in FIG. 4. The spring cup 26 also accommodates a spring 41 that biases the valve 25 into a closed position where the stem orifices 43 are disposed below (in the orientation of FIG. 2) the gasket wall 44 and the stem gasket 45 engages the gasket wall 44 to close the valve 25. Depression of the actuator 28 in the direction of the arrow 46 opens communication between the passages 47, 48, 49, 37 and out through the nozzle 36.

An alternative actuator body 29 is shown in FIG. 3 with the exit orifice 51 directed at a more downwardly angle.

FIG. 4 illustrates the mesh filter extension of 40 which includes a lower base 60 that fits within the rim 61 (FIG. 2) of the valve body stem 38. The base 60 is equipped with one or more barbs 61 to help prevent dislodgement of the mesh filter 40 from the stem 38. Obviously, other types of frictional or mateable engagements between the base portion 60 of the mesh filter extension 40 and the valve stem 38 are possible and are considered within the scope of this disclosure. In the embodiment illustrated in FIG. 4, the filter or mesh portion 62 is conically shaped and includes a plurality of pores or holes shown schematically at 63.

When the product 31 includes particles (not shown) having diameters ranging from about 40 to about 60 microns, and the pore size or the size of the holes or pores 63 can range from about 80 to about 500 microns, depending upon the tendency of the particles to conglomerate or flocculate. Obviously, the pore size will depend upon the particles, the concentration of the particles, the formulation of the product 31 and, possibly, the propellant 32.

In one embodiment, the container 21 accommodates a composition for applying a colorant to a surface, which comprises: a) from about 0.3 to about 13.5% by weight a fluid matrix component comprising: i) from about 0.1 to about 4% by weight of a rheology modifier, ii) from about 0.15 to about 3.5% by weight of a multi-component suspension stabilizer comprising at least one of an acrylic acid copolymer or a surfactant, iii) from about 0.05 to about 2% by weight an anticorrosive agent, iv) from about 0 to about 2% by weight of a propylene glycol, and v) from about 0 to about 2% by weight of a water soluble polymer; b) from about 3 to about 10% by weight solid homogeneous particles having a mean particle size of from about 35 microns to about 75 microns and comprising a colorant, an additive, and at least one of a thermoplastic or a thermoset resin; and c) a liquid carrier.

In this specific example, the pore size can range from about 100 to about 500 microns, preferably about 300 microns. In the above concentration, the number of pores or openings 63 can range from about 100 to about 500, more preferably from about 200 to about 400. One exemplary mesh filter element 40 includes slightly less than 300 pores 63 with an average diameter of about 300 microns.

Obviously, pore sizes, number of pores and the length of the mesh filter can all vary greatly and will depend upon the formulation being dispensed, the propellant, container pressure, nozzle design, valve design, etc.

Returning to FIGS. 4-5, the mesh filter element 40 includes a flange 64 that rests or engages the rim or wall 65 of the lower spring cup 26 when the mesh filter element 40 has been firmly pushed in the direction of the arrow 66 to its installed position as shown in FIG. 6.

Figure 7:
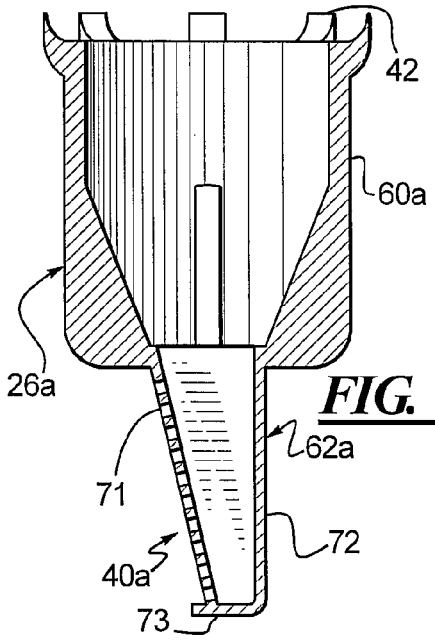
FIG. 7 is a side sectional view of a valve spring cup with an integral alternative mesh filter extension.
Figure 8:
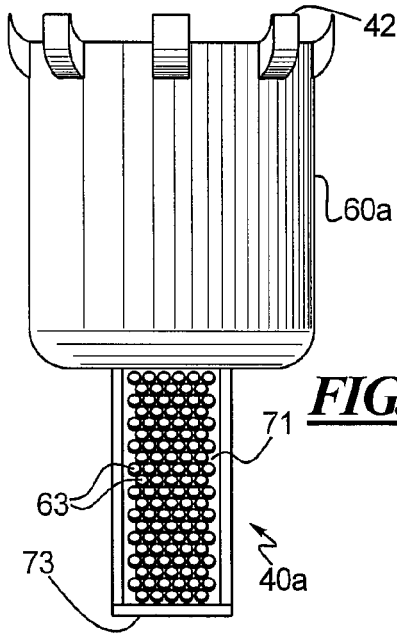
FIG. 8 is a front plan of the valve spring cup and mesh filter extension shown in FIG. 7.
Figure 9:
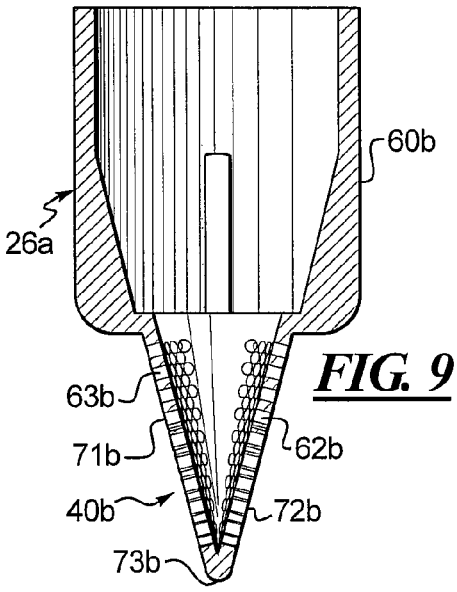
FIG. 9 is a sectional view of yet another disclosed valve spring cup with an integral mesh filter extension.
Figure 10:
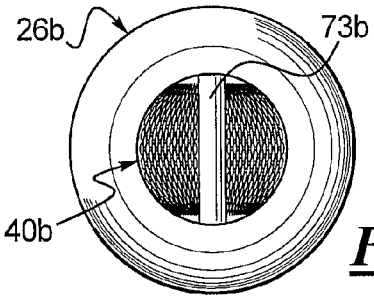
FIG. 10 is a top view of the mesh filter extension shown in FIG. 9.

FIGS. 7-14 illustrate five additional mesh filter elements 40*a*, 40*b*, 40*c*, 40*d* and 40*e* that are integrally connected to or molded with the spring cups 26*a*, 26*b*, 26*c*, 26*d* and 26*e* that are part of the valve 25 shown in FIG. 2. In FIGS. 7-8, the spring cup 26*a*/mesh filter element 40*a* includes a cylindrical base 60*a* connected to a tapered filter element 62*a* which includes one porous wall 71 and one solid wall 72. Tabs, grips or flange members are shown at 42 for securing the spring cup 26*a* to the inside surface 35 of the mounting cup 23. Turning to FIGS. 9-10, the spring cup 26*b*/mesh filter element 40*b* includes a cylindrical base 60*b* and a tapered filter 62*b* with both walls 71, 72 being porous or including openings 63*b*. In the embodiments 26*a*/40*a*, 26*b*/40*b* of FIGS. 7-10, the distal ends 73, 73*b* are solid or non-porous and provide structural integrity.

Figure 11:
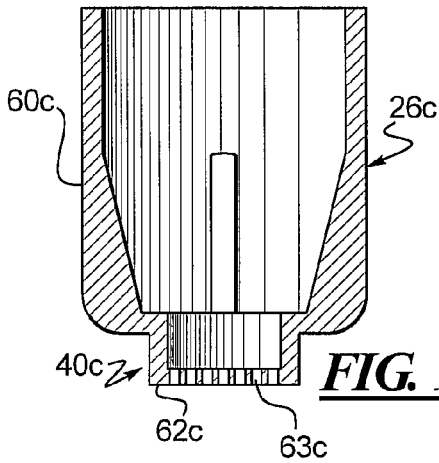
FIG. 11 is a sectional view of yet another disclosed valve spring cup with an integral mesh filter extension.
Figure 12:
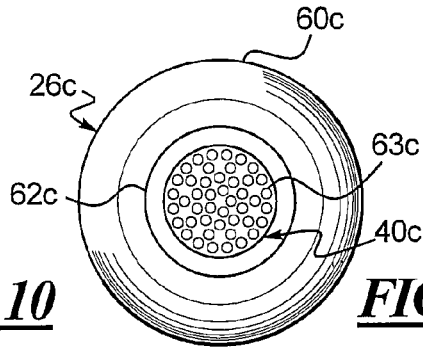
FIG. 12 is a top view of the mesh filter extension shown in FIG. 11.
Figure 13:
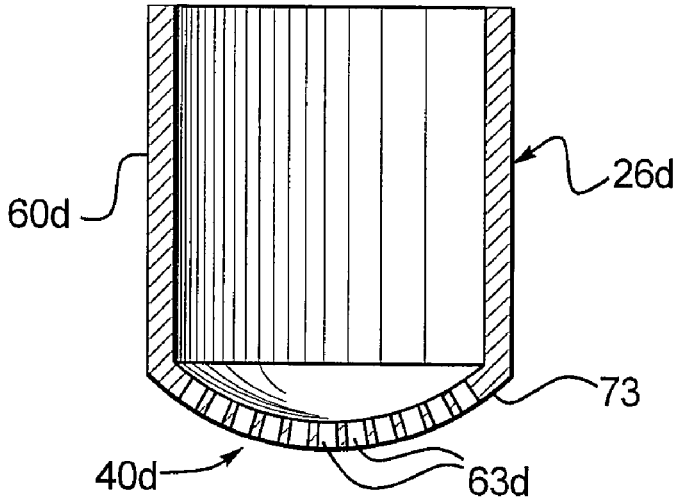
FIG. 13 is a sectional view of yet another disclosed valve spring cup with an integral mesh filter extension.
Figure 14:
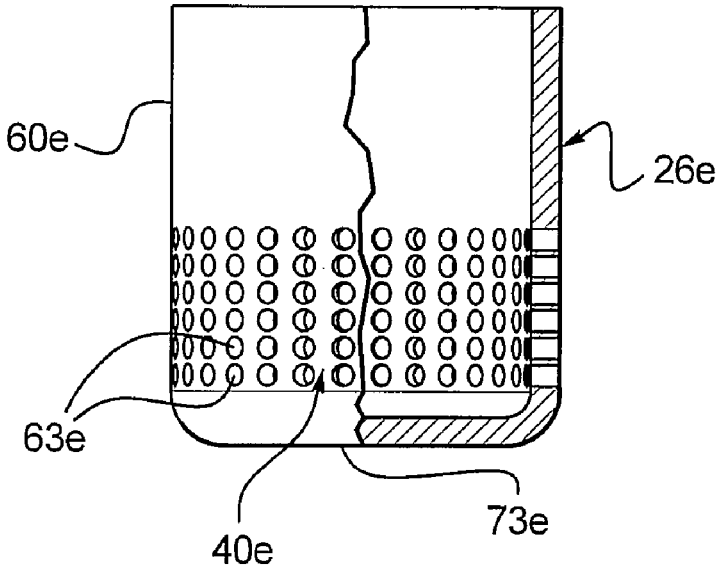
FIG. 14 is a partial sectional view and front plan view of yet another disclosed valve spring cup with an integral mesh filter extension.

In contrast, in the embodiment 26*c* illustrated in FIGS. 11-12, the spring cup 26*c* includes a cylindrical base 60*c* connected to a smaller cylindrical extension 62*c* which includes the pores or openings 63*c* at its distal end that provide the filter mesh 40*c*. Similarly, the combination spring cup/mesh filter structures 26*d*/40*d*, 26*e*/40*e* of FIGS. 13-14 respectively include a cylindrical bases 60*d*, 60*e* where the pores 63*d* are disposed on the bottom 73*d* of the cylindrical section 60*d* (FIG. 13) or, with a solid bottom 73*e*, the pores 63*e* being disposed along the lower portion of the sidewall of the cylindrical base 60*e* (FIG. 14).

Obviously, only several of the possible mesh filter extension designs have been disclosed. While only these certain embodiments have been set forth, numerous alternatives and modifications will be apparent from the above description to those skilled in the art. These and other alternatives are considered equivalents and within the spirit and scope of this disclosure and the appended claims.

What is claimed:

1. A product for inverted dispensing, the product comprising:

a container containing a product therein, the product comprising solid particles, the container comprising a dispensing end having an actuator, the dispensing end of the container being connected to a valve, the valve being moveable from a biased closed position to an open position for discharging the product downward through the valve when the dispensing end of the container is directed downward and the actuator is depressed in an upward direction, the valve comprising an inlet end disposed within the container, the inlet end of the valve being spaced vertically above the dispensing end of the container when the dispensing end of the container is directed downward, the inlet end of the valve being connected to a mesh filter having a pore size at least as large as an average diameter of the solid particles; and wherein, when the container is inverted and the dispensing end is directed downward, the product comprises a layer of settled particles extending upward from the dispensing end to a predetermined level, and wherein at least a portion of the proximal end of the mesh filter is disposed above the predetermined level at all times.

2. The product of claim 1 wherein the valve comprises a spring cup connected to the valve, the inlet end of the valve being connected to the mesh filter spaced above the dispensing end of the container.

3. The product of claim 2 wherein the spring cup and mesh filter are a unitary molded component.

4. The product of claim 1 wherein the solid particles have diameters ranging from about 40 to about 60 microns.

5. The product of claim 4 wherein a pore size of the mesh filter ranges from about 80 to about 500 microns.

6. The product of claim 4 wherein the mesh filter comprises from about 100 to about 500 pores.

7. The product of claim 4 wherein the container is an aerosol container containing propellant.

8. A combination spring cup and filter for a dispenser for inverted spray dispensing, the combination spring cup and filter comprising:

a cup for accommodating a spring, the cup comprising a distal rim for engaging a mounting cup of the aerosol dispenser, a proximal end and mesh filter disposed between the distal rim and proximal end, the cup and mesh filter being integrally connected; and wherein the mesh filter comprises a distal cylindrical end connected to an inlet end of the spring cup and a tapered proximal end that comprises the mesh filter, the tapered proximal end comprising one solid side and one porous side.

9. The combination of claim 8 wherein the mesh filter comprises a generally cylindrical screen sidewall extending between the distal and proximal ends of the mesh filter.

10. The combination of claim 8 wherein the tapered proximal end comprises one solid portion and one meshed portion.

11. The combination of claim 8 wherein the mesh filter comprises a distal cylindrical end connected to the inlet end of the spring cup and a proximal cylindrical section with a proximal end that comprises the mesh filter.

12. The combination of claim 8 wherein the combination spring cup and filter comprises part of an aerosol dispenser.

13. The combination of claim 8 wherein the mesh filter comprises a cylindrical section connected to the inlet end of the spring cup, the cylindrical section comprising a sidewall that comprises the mesh filter.

14. The combination of claim 8 wherein the mesh filter comprises a first cylindrical section connected to the inlet end of the spring cup and disposed between a second narrower cylindrical section that comprises a proximal end that comprises the mesh filter.

15. A method of dispensing product comprising particles from a container in an inverted position, the container comprising a dispensing end having an actuator, the dispensing end of the container being connected to a valve, the valve moving from a biased closed position to an open position upon a movement of said valve to discharge the product downward through the valve when the dispensing end of the container is directed downward, the valve comprising an inlet end disposed within the container, the inlet end of the valve being spaced vertically above the dispensing end of the container when the dispensing end of the container is directed downward, the inlet end of the valve being connected to a mesh filter having a pore size at least as large as an average diameter of the solid particles, the method comprising:

inverting the container with the dispensing end directed downward;

allowing at least some of the particles to settle at the dispensing end of the container to provide a layer of settled particles extending upward from the dispensing end upward to a predetermined level below at least a portion of the mesh filter, the mesh filter extending above the predetermined level at all times, and;

depressing the actuator in an upward direction to move the valve to dispense product downward through the mesh filter.

16. The method of claim 15 wherein the solid particles have diameters ranging from about 40 to about 60 microns, wherein a pore size of the mesh filter ranges from about 80 to about 500 microns, and wherein the mesh filter comprises from about 100 to about 500 pores.

17. The method of claim 15 wherein container is an aerosol container containing at least some propellant.

* * * * *